US006308683B1

(12) United States Patent
Pursifull et al.

(10) Patent No.: US 6,308,683 B1
(45) Date of Patent: Oct. 30, 2001

(54) CYLINDER AIR CHARGE ESTIMATION ASSEMBLY

(75) Inventors: Ross Dykstre Pursifull, Dearborn; Allan Joseph Kotwicki, Williamsburg, both of MI (US)

(73) Assignee: Ford Global Tech, Inc., Dearborn, MI (US)

( * ) Notice: Subject to any disclaimer, the term of this patent is extended or adjusted under 35 U.S.C. 154(b) by 0 days.

(21) Appl. No.: 09/478,698

(22) Filed: Jan. 6, 2000

(51) Int. Cl.[7] ..... F02D 1/00
(52) U.S. Cl. ..... 123/399; 123/478
(58) Field of Search ..... 123/478, 361, 123/399, 480

(56) References Cited

U.S. PATENT DOCUMENTS 5,642,709 * 7/1997 Ozaki et al. ..... 123/478
5,845,619 * 12/1998 Reichlinger ..... 123/361
5,931,136 * 8/1999 Isobe et al. ..... 123/399
6,006,725 * 12/1999 Stefanopoulou et al. ..... 123/399
6,014,955 * 1/2000 Hosotani et al. ..... 123/478
6,016,788 * 1/2000 Kibe et al. ..... 123/399
6,021,755 * 2/2000 Maddock et al. ..... 123/361
6,199,537 * 3/2001 Kowatari et al. ..... 123/478
6,263,858 * 7/2001 Pursifull et al. ..... 123/361

* cited by examiner

*Primary Examiner*—John Kwon
(74) *Attorney, Agent, or Firm*—Ford Global Technologies, Inc.

(57) ABSTRACT

An cylinder air charge estimation assembly 12 for use with an internal combustion engine 10 having at least one cylinder 14. Assembly 12 dynamically estimates the amount of air contained within the at least cylinder 14 of the engine 10 by the dynamic use of one of two unique air charge estimation techniques.

20 Claims, 1 Drawing Sheet

CYLINDER AIR CHARGE ESTIMATION ASSEMBLY

FIELD OF THE INVENTION

This invention relates to a cylinder air charge estimation assembly and more particularly, to an assembly which dynamically estimates the amount of air resident within the cylinders of an engine by the use of several estimation methodologies and/or techniques.

BACKGROUND OF THE INVENTION

An internal combustion engine, such as that which is typically deployed within a vehicle, respectively includes several cylinders into which air and fuel are selectively mixed. The air-fuel mixture is then ignited, effective to cause a piston to move and to impart torque upon a crankshaft, thereby allowing the vehicle to be driven.

In order to reduce the amount of undesirable emissions, in order to reduce undesirable vibration or "engine knocking", and in order to allow the engine to more efficiently utilize the fuel, it is desirable to cause the ratio of the contained air and fuel within each of the respective engine cylinders to substantially equal a certain value or to reside within a relatively narrow range of values.

This objective is typically achieved by estimating the amount of air which is contained within each of the cylinders, commonly referred to as "the air charge", and then, based upon these respective estimates, dynamically regulating or metering the amount of fuel which is operatively communicated into the respective cylinders. Conventionally, the air charge is estimated by use of only one of four known techniques or methodologies which respectively utilize the engine speed and throttle position; the engine speed and the pressure of the intake manifold; the engine speed and a measured flow rate of air entering the intake manifold; and the position of the throttle and the pressure which is resident within the intake manifold.

Each of these previously delineated techniques has certain undesirable and varying measurement inaccuracies. The use of only one of these four previously delineated techniques therefore produces air-charge estimates having varying degrees or amounts of inaccuracy, thereby preventing the attainment of the previously delineated and desired cylinder air-fuel ratio. The third previously delineated technique is also undesirable since it requires the use of a relatively costly flow meter, thereby further increasing overall vehicle costs and undesirably increasing the complexity of the engine assembly.

There is therefore a need for a cylinder air-charge estimation assembly and technique which overcomes at least some of the previously delineated drawbacks of prior air-charge estimation assemblies and techniques and which, more particularly, allows the air-fuel ratio of each of the engine cylinders to be made substantially and respectively equal to a certain desired value or to reside within a relatively narrow range of desired values as the engine is operated.

SUMMARY OF THE INVENTION

It is a first object of the invention to provide a cylinder air charge estimation assembly and technique which overcomes at least some of the drawbacks of prior cylinder air charge estimation assemblies and techniques.

It is a second object of the invention to provide a cylinder air charge estimation assembly which overcomes at least some of the drawbacks of prior cylinder air charge estimation assemblies and which uses several air charge estimation techniques and/or methodologies, effective to provide a relatively accurate estimate of the amount of air contained within each of the cylinders of an engine.

It is a third object of the invention to provide a cylinder air charge estimation assembly which allows for the dynamic metering of fuel into each of the engine cylinders, effective to substantially reduce undesired engine emissions, to substantially reduce undesirable engine vibrations or "knock", and to allow the fuel to be efficiently utilized by the engine.

According to a first aspect of the present invention, an assembly is provided for use with an engine of the type having at least one cylinder which operably contains a certain amount of air. The assembly includes a controller; a first sensor which is coupled to the controller and which selectively provides certain first information to the controller; a second sensor which is coupled to the controller and which selectively provides certain second information to the controller; a third sensor which is coupled to the controller and which selectively provides certain third information to the controller. The third information is selectively used by the controller in combination with the certain first information to estimate the certain amount of air by a first technique and is selectively used by the controller in combination with the certain second information to estimate the certain amount of air by a second technique. The third information has a value which is used by the controller to select only one of the first and second techniques.

According to a second aspect of the invention, a method is provided for estimating the amount of air contained within a cylinder of an engine, the engine operating at a certain speed and being of the type having a throttle which selectively occupies a certain position. The method includes the steps of measuring the speed; measuring the throttle position; providing a first and a second cylinder air estimating technique; selecting one of the first and second cylinder air estimating techniques by use of the measured engine speed and throttle position; and estimating the amount of air contained within the cylinder by use of the selected one of the first and second cylinder air estimating techniques.

These and other features, aspects, and advantages of the invention will become apparent from a reading of the following detailed description of the preferred embodiment of the invention, including the subjoined claims, and by reference to the following drawings.

DETAILED DESCRIPTION OF THE PREFERRED EMBODIMENT OF THE INVENTION

Figure 1:
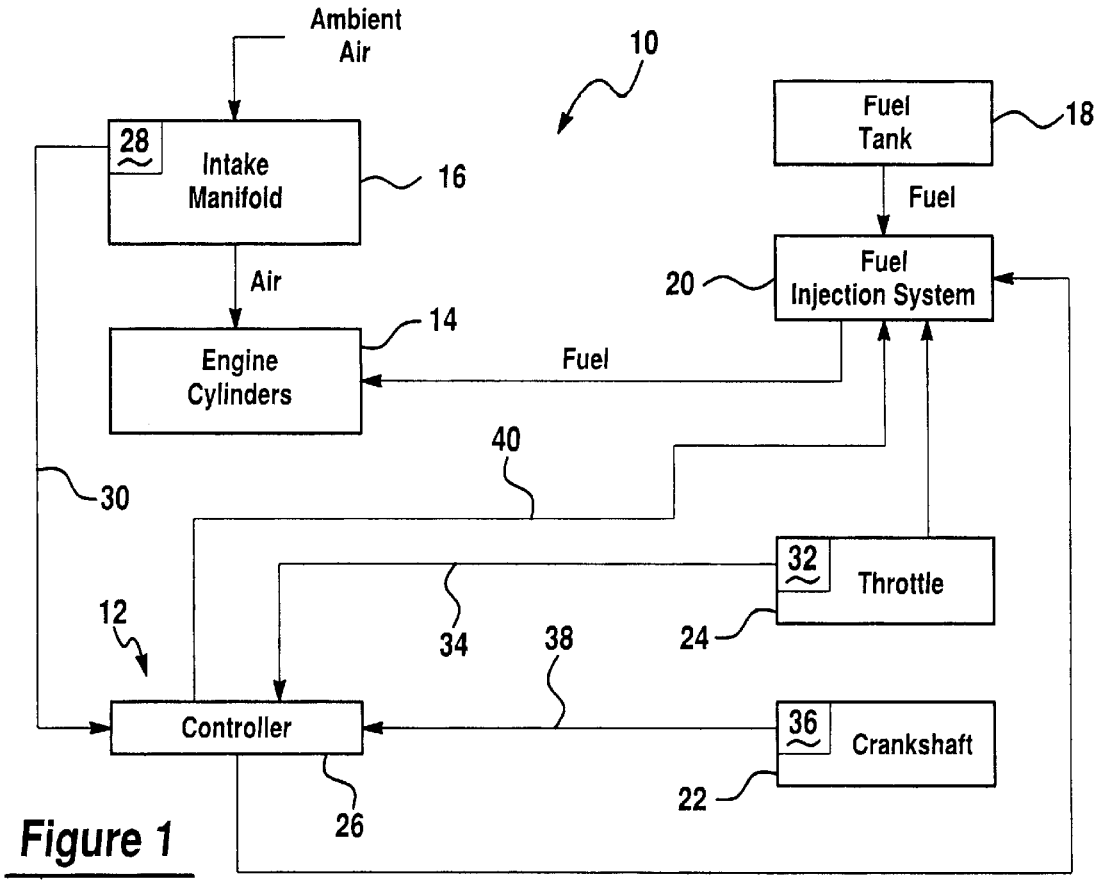
FIG. 1 is a partial block diagram of a typical vehicle internal combustion engine which employs the air cylinder estimating assembly of the preferred embodiment of the invention.

Referring now to FIG. 1, there is shown a portion of a typical vehicle internal combustion engine 10 which includes a cylinder air estimating assembly 12 which is made in accordance with the teachings of the preferred embodiment of the invention. Particularly, engine 10 includes several engine cylinders 14 which are adapted to selectively receive air from an intake manifold 16 and fuel which is selectively pumped from or provided from the fuel tank 18 by the fuel injection system or assembly 20.

The received air and fuel are selectively and respectively mixed within each of the cylinders 14 and selectively ignited. The ignited air-fuel mixture causes a piston (not shown) which is respectively contained within each of the cylinders 14 to apply a torque or rotational force upon the crankshaft 22, effective to allow the vehicle (not shown) to be driven. Engine 10 further includes a throttle 24 which selectively occupies one of several driver determined positions by the use of the accelerator pedal or member (not shown) and which is effective to cause the fuel injection system 20 to selectively increase or decrease the amount of fuel provided to the cylinders 14, effective to regulate the operating speed of the engine.

The cylinder air charge estimation assembly 12 of the preferred embodiment of the invention includes a controller 26 which operates under stored program control and a pressure sensor 28 which is physically and communicatively coupled to the controller 26 by bus 30 and which measures and communicates, to controller 26, the pressure resident within the intake manifold 16. The sensor 28 may comprise one of three types of sensors including but not limited to an absolute pressure sensor which provides a value of the "absolute pressure" resident within the intake manifold 16, a vacuum sensor, or a differential pressure sensor which is communicatively coupled to the intake manifold 16 and which may be positioned "upstream" of the throttle 24.

Assembly 12 further includes a throttle position sensor 32 which is physically and communicatively coupled to the controller 26 by bus 34 and which selectively measures the position of the throttle 24 and which communicates the measured throttle position to the controller 26 by use of bus 34. Assembly 12 also includes a crankshaft position sensor 36 which is physically and communicatively coupled to the controller 26 by bus 38 and which measures the rotational speed of the crankshaft 22 and which communicates the measured crankshaft rotational speed to the controller 26 by use of bus 38.

In operation, controller 26 selectively and "dynamically" utilizes at least two unique cylinder air charge estimation techniques in order to provide a relatively accurate measurement of the amount of air contained within each of the engine cylinders 14. The term "dynamically" as used in this discussion, means that multiple estimation techniques are potentially used by controller 26 and that a single one of the techniques is selected depending upon the then measured/estimated and dynamically changing operating state of the engine 10. The dynamically estimated air charge is then used by the controller 26 to appropriately meter an amount of fuel which is communicated into the respective cylinders 14 by the fuel injection system 20. Particularly, such metering is accomplished by the use of fuel injection system control signals which are generated by the controller 26 and which are communicated to the fuel injection system 20 by use of bus 40. The use of these two unique estimation techniques is explained below.

Figure 2:
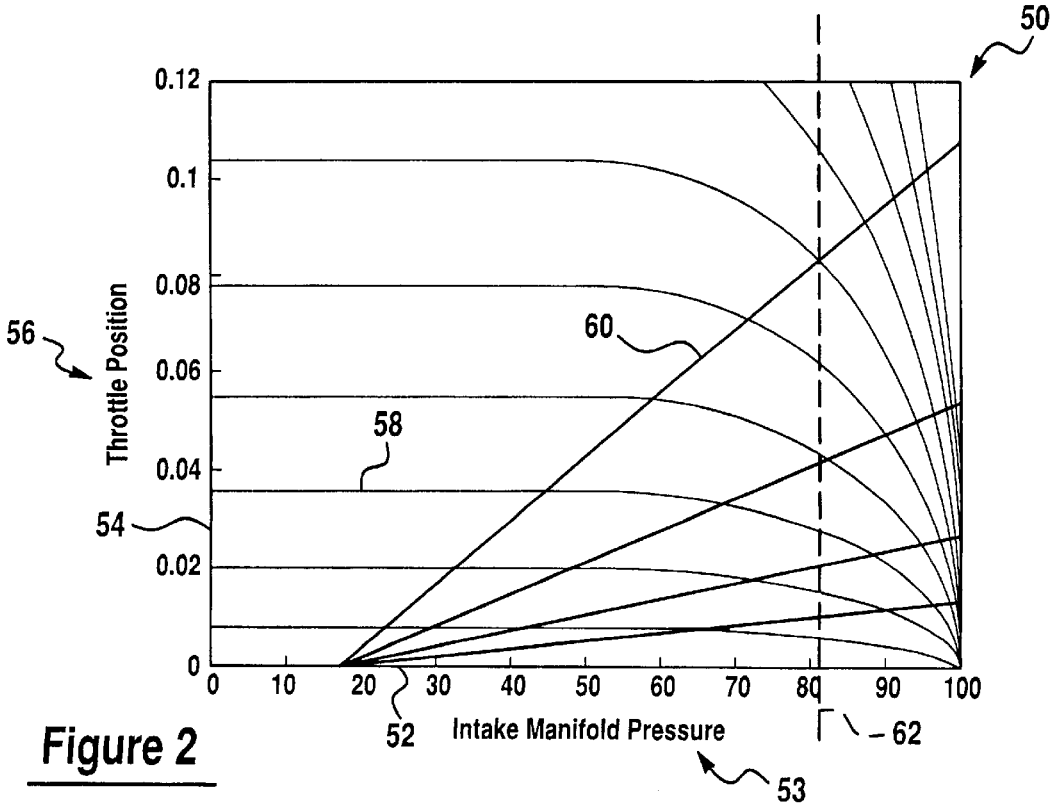
FIG. 2 is a graph which illustrates the relationship between the speed of the engine which is shown in FIG. 1, the position of the throttle portion of the engine which is shown in FIG. 1, and the pressure of the intake manifold portion of the engine which is shown in FIG. 1.

Referring now to FIG. 2, there is shown a graph 50 which pictorially delineates the relationship between the "speed attribute" or operating speed of the engine 10, the position of the throttle 24 or "throttle position attribute", and the pressure resident within the intake manifold 16 or the intake manifold "pressure attribute". Particularly, axis 52 corresponds to or contains values 53 associated with the intake manifold pressure while axis 54 corresponds to or contains values 56 associated with the angular throttle position. Curves 58 represent the operative relationship between values 53 and 56. Curves or axes 60 each correspond to a unique and singular engine operating speed and may operatively overlay curves 58, thereby cooperating with curves 58 to provide a graphical representation of the relationship between engine speed, throttle position, and intake manifold pressure. It should be appreciated that values 56 are provided to controller 26 by sensor 32 and that values 53 are provided to controller 26 by sensor 28. Engine speed values are provided to controller 26 by sensor 36. Hence, in the preferred embodiment of the invention, controller 26 selectively and periodically receives the information which is contained within graph 50 and this information is dynamic (i.e., changes over time).

In the preferred embodiment of the invention, controller 26 dynamically determines the air charge within the cylinders 14 at periodic and predetermined intervals or periods of time by the use of one of two cylinder air charge estimation techniques.

That is, in the preferred embodiment of the invention, a first conventional cylinder air charge estimation technique utilizing the value of the throttle position attribute and the value of the intake manifold pressure attribute is used. Particularly, this first technique makes use of the following known equation:

$$m_{cyl} = \frac{\dot{m}_{air}}{n \cdot \left(\frac{numcyl}{2}\right)} \qquad \text{(Equation 1)}$$

where "$m_{cyl}$" denotes the amount of air in a cylinder; "n" denotes engine speed; "numcyl" denotes or equals the number of cylinders within the engine; and "$m_{air}$" is the measurement of airflow into the intake manifold 16 which is a known function of throttle position.

A second conventional cylinder air charge estimation technique utilizing the value of the engine speed attribute and the value of the intake manifold pressure attribute are also used. Particularly, the second technique makes use of the following known equation:

$$\frac{m_{cyl}}{n} = (P_m - P_{offset})(\text{slope}) \qquad \text{(Equation 2)}$$

where "$m_{cyl}$" denotes the amount of air in a cylinder; "n" denotes engine speed; "$P_m$" denotes the pressure within the manifold; "slope" denotes the slope of the graph or line representing the relationship between the variables $$\text{“}\frac{m_{cyl}}{n}\text{”}$$

and "$P_m$" over some desired time interval; and the term "$P_{offset}$" denotes or is equal to the distance between the intersection of the graph or line used to acquire the "slope" value on the traditional two dimensional "x" or horizontal axis and the origin of the "x" axis. More particularly, one of these two air charge estimation techniques is chosen for use during each interval of time for which assembly 12 provides such estimates, in the manner which is more fully set forth below.

That is, as best shown in graph 50, the first air charge estimation technique which utilizes the throttle position attribute and the intake manifold pressure attribute is used by controller 26 "as long as" or each time that the absolute value of the slope (i.e., "change in" or gradient of the throttle position attribute) of the pertinent throttle position curve 58 is less than or is equal to the absolute value of the slope (i.e., "change in", or gradient of the engine speed attribute) of the pertinent engine speed curve 60, thereby ensuring the use of the most accurate of the two utilized potential cylinder air charge estimation techniques. The term "pertinent" in this context or discussion, means the curve 58, 60 or the portion of the curve 58, 60 which is representative of the then current operating state of the vehicle (i.e., "the pertinent curve 58" means the curve 58 or portion of the curve 58 which is representative of the then currently measured value of the throttle position). The slope or gradient measurements may be made over any desired interval of time (i.e., between the time of the last or most recent cylinder air charge estimation and the current time).

The second technique which utilizes the engine speed attribute and the intake manifold pressure attribute is used by controller 26 only when the absolute value of the slope of the pertinent curve 58 is greater than the absolute value of the pertinent curve 60. The point on the pertinent curve 60 at which the absolute value of the slope of the pertinent curve 60 is equal to the absolute value of the slope of the pertinent curve 58 is referred to as a "boundary point". By use of two techniques, relatively accurate air containment estimates may be made, thereby allowing for the creation of desirable air-fuel ratios within each of the engine cylinders.

In an alternate and non-limiting embodiment, to simplify the foregoing process, the respective boundary points of several curves 60 cooperatively form an axis 62 of relatively or substantially constant intake manifold pressure. Hence, by noting the value of the measured intake manifold pressure attribute, from sensor 28, and comparing the current measured value with the value associated with axis 62, controller 26 may quickly and easily determine which of the two estimation techniques is to be dynamically utilized at this measurement instant of time.

It is to be understood that the invention is not limited to the exact construction and method which has been previously delineated, but that various changes and/or modifications may be made without departing from the spirit and the scope of the invention which is delineated within the following claims.

What is claimed is:

1. An assembly for use in combination with a vehicle of the type having an engine which operates at a certain speed and which includes at least one cylinder which operably contains air, a selectively positionable throttle which selectively moves by a certain amount, and an intake manifold, said assembly comprising:

a controller which estimates said amount of air contained within said at least one cylinder by using a position of said throttle and said pressure within said intake manifold when said certain amount is less than a certain value.

2. The assembly of claim 1 wherein said controller estimates said amount of said air contained within said at least one cylinder by use of said speed of said engine and said pressure within said manifold only when said certain amount is above said certain value.

3. The assembly of claim 2 wherein said certain value is based upon said speed said engine.

4. The assembly of claim 2 wherein said intake manifold contains a certain pressure and wherein said certain value substantially equals to a constant value of said pressure of said intake manifold.

5. The assembly of claim 1 further comprising a source of fuel; and a fuel injection system which is coupled to said controller and which selectively causes a certain amount of said fuel to be communicated to said at least one cylinder in response to said estimate by said controller.

6. The assembly of claim 1 wherein said controller estimates said amount of air by use of said position of said throttle and said pressure within said intake manifold when said certain amount is equal to a second value.

7. An assembly for use with an engine of the type having at least one cylinder which operably contains a certain amount of air, said assembly comprising:

a controller;

a first sensor which is coupled to said controller and which selectively provides certain first information to said controller;

a second sensor which is coupled to said controller and which selectively provides certain second information to said controller; and a third sensor which is coupled to said controller and which selectively provides certain third information to said controller, said certain third information being selectively used by said controller in combination with said certain first information to estimate said certain amount of air by a first technique, said certain third information being selectively used by said controller in combination with said certain second information to estimate said certain amount of air by a second technique, and said third information having a value which is used by said controller to select only one of said first and second techniques.

8. The assembly of claim 7 wherein said first sensor comprises an engine speed sensor.

9. The assembly of claim 8 wherein said second sensor comprises a throttle position sensor.

10. The assembly of claim 9 wherein said second sensor comprises an intake manifold pressure sensor.

11. The assembly of claim 10 wherein said assembly further comprises:

a source of fuel;

a fuel injection system which is coupled to said controller and which selectively communicates a portion of said fuel to said at least one cylinder in response to said estimation of said certain amount of air which is made by said controller.

12. The assembly of claim 11 wherein said value of said third information comprises a throttle position gradient.

13. A method for estimating the amount of air contained within a cylinder of an engine, said engine selectively operating at a certain speed and being of the type having a throttle which selectively occupies a certain selectable position and having an intake manifold which has a certain pressure, said method comprising the steps of:

measuring the speed of said engine;

measuring the position of said throttle;

providing a first and second air estimating technique;

selecting one of said first and second air estimating techniques by use of said measured engine speed and said measured throttle position; and estimating the amount of said air contained within said cylinder by use of said selected one of the first and second air estimating techniques.

14. The method of claim 13 wherein said first air estimating technique utilizes said speed of said engine and said pressure of said intake manifold.

15. The method of claim 14 wherein said second air estimating technique utilizes said pressure of said intake manifold and said position of said throttle.

16. The method of claim 15 further comprising the step of creating a certain constant pressure value by use of said engine speed and throttle position; and using said constant pressure value to select one of said first and second air cylinder estimating techniques.

17. The method of claim 13 wherein said cylinder selectively receives fuel, said method further comprising the step of regulating said fuel by use of said one of said first and second air cylinder estimating techniques.

18. The method of claim 13 wherein said speed of said engine changes by a first certain amount and wherein said first of said air estimating techniques is used when said first certain amount is above a certain value.

19. The method of claim 18 wherein said second one of said air estimation techniques is used only when said first certain amount is below said certain value.

20. The method of claim 18 wherein said position of said throttle changes by a second certain amount and wherein said first one of said air estimation techniques is used only when said certain amount is less than a certain value.

* * * * *